US010068731B2

(12) United States Patent
Zhong et al.

(10) Patent No.: US 10,068,731 B2
(45) Date of Patent: Sep. 4, 2018

(54) FRAMEWORK OF RELAY AND RELAY

(71) Applicant: Xiamen Hongfa Electric Power Controls Co., Ltd., Xiamen, Fujian (CN)

(72) Inventors: Shuming Zhong, Fujian (CN); Shengsheng Shi, Fujian (CN)

(73) Assignee: Xiamen Hongfa Electric Power Controls Co., Ltd., Xiamen, Fujian (CN)

( * ) Notice: Subject to any disclaimer, the term of this patent is extended or adjusted under 35 U.S.C. 154(b) by 73 days.

(21) Appl. No.: 14/902,915

(22) PCT Filed: May 30, 2014

(86) PCT No.: PCT/CN2014/078922
§ 371 (c)(1),
(2) Date: Jan. 5, 2016

(87) PCT Pub. No.: WO2015/000344
PCT Pub. Date: Jan. 8, 2015

(65) Prior Publication Data

US 2016/0133404 A1 May 12, 2016

(30) Foreign Application Priority Data

Jul. 5, 2013 (CN) ..... 2013 2 0399979 U

(51) Int. Cl.
*H01H 33/18* (2006.01)
*H01H 9/44* (2006.01)
(Continued)

(52) U.S. Cl.
CPC ..... *H01H 33/18* (2013.01); *H01H 9/443* (2013.01); *H01H 50/042* (2013.01);
(Continued)

(58) Field of Classification Search
CPC .. H01H 33/18; H01H 50/06; H01H 2205/002; H01H 2235/012
(Continued)

(56) References Cited

U.S. PATENT DOCUMENTS 3,391,359 A 7/1968 Ameberg et al.
6,693,248 B1 * 2/2004 Schultz ..... H01H 51/08 200/1 R
(Continued)

FOREIGN PATENT DOCUMENTS

CN 101447347 A 6/2009
CN 202111008 U 1/2012
(Continued)

OTHER PUBLICATIONS

Machine Translation of CN202221739, May 16, 2012.*
(Continued)

*Primary Examiner* — Bernard Rojas
(74) *Attorney, Agent, or Firm* — Renner, Otto, Boisselle & Sklar, LLP

(57) ABSTRACT

A framework part of a relay and a relay. An inner hollow portion and peripheral windows are formed by the framework. The windows are communicated with the exterior of the framework and the hollow portion. At least one group of contactors that can correspondingly contact are accommodated in the hollow portion. An arc gap is formed between the contactors that can correspondingly contact. The windows are aligned with the arc gap from an outer side. A main body of the framework is a hollowed injection molding framework, and has multiple windows that are aligned with the arc gap from the outer side, so that, under the precondition of ensuring the structural strength, materials can be reduced and the cost can be reduced. The windows can be used for installing functional components such as magnetic
(Continued)

steel, a resistant act clip or an arcing and are extinguishing piece. The framework is made be applicable to relays and breakers having more functions and requirements, so as to improve a scope of application of products to a great extent and facilitate reduction of molds and other manufacturing costs.

14 Claims, 11 Drawing Sheets

(51) Int. Cl.
*H01H 50/54* (2006.01)
*H01H 50/06* (2006.01)
*H01H 50/04* (2006.01)
*H01H 9/36* (2006.01)

(52) U.S. Cl.
CPC ..... *H01H 50/045* (2013.01); *H01H 50/06* (2013.01); *H01H 50/546* (2013.01); *H01H 9/362* (2013.01); *H01H 2205/002* (2013.01); *H01H 2235/012* (2013.01)

(58) Field of Classification Search
USPC ..... 335/201, 202
See application file for complete search history.

(56) References Cited

U.S. PATENT DOCUMENTS

| | | | |
|---|---|---|---|
| 2005/0156469 | A1 | 7/2005 | Nishida et al. |
| 2013/0229247 | A1 | 9/2013 | Tachikawa et al. |

FOREIGN PATENT DOCUMENTS

| | | | |
|---|---|---|---|
| CN | 202221739 | U | 5/2012 |
| CN | 103155080 | A | 6/2013 |
| CN | 203325803 | U | 12/2013 |
| JP | 2005183285 | A | 7/2005 |

OTHER PUBLICATIONS

Machine Translation of CN103155080, Jun. 12, 2013.*
International Search Report for corresponding International Application No. PCT/CN2014/078922 dated Sep. 3, 2014.
Extended European Search Report received in corresponding Application No. 14820573.5 dated Jan. 23, 2017.

* cited by examiner

FRAMEWORK OF RELAY AND RELAY

This application is a national phase of International Application No. PCT/CN2014/078922 filed May 30, 2014, which claims priority to Application No. CN 201320399979.5 filed Jul. 5, 2013.

TECHNICAL FIELD

The present disclosure relates to a relay, particularly to a framework of a relay.

BACKGROUND

A relay is a disconnecting or breaking and connecting or closing device that can frequently disconnect or break, carry and connect or close a normal current and a regulated overload current. An existing relay is an electric device that closes the contacts by means of a magnetic field created by a current flowing through a coil, so as to control the load. It is widely used in the fields o electric power, electric distribution, electric consumption, and so on.

In some alternating current or direct current contactors (relays), a framework main body, a lead terminal portion, a movable spring portion, a magnetic circuit system, and pushing mechanism are generally included. The lead terminal portion includes a lead terminal and a stationary contact; the stationary contact is fixed to the bottom of the lead terminal. The movable contact is fixed to the movable spring piece of the movable spring portion and the movable spring portion is correspondingly located inside the framework main body and is pushed by it pushing mechanism. The stationary contact of the lead terminal portion is matched with the movable contact of the movable spring portion, respectively, so as to achieve closing or breaking of the relay. Here, the main material of the framework main body is plastic.

However, when the relay is applied for a relatively higher load, i.e., a circuit having a disconnecting or breaking voltage higher than 10V and a current over 100 mA, a conductive gas mass, which is called electric arc, with extremely high temperature and brightness is created m the contact gap (or to say, arc gap). Electric arcs are a type or aerial discharge. In case that the electric arc strikes the plastic material around the contact, the plastic may be carbonized, the insulation property to be decreased sharply, and the relay may be even burned in a serious situation.

In the prior direct current relays, another solution is that the whole framework is made of a ceramic material, such as the relays in the disclosure of Chinese patent publication CN 102737914A. However, due to the properties of ceramic materials, such framework is typically complex in structure, uncertain in size, and large in weight, and thusly resulting a high cost.

Such prior relay generally comprises pushing mechanism and a framework portion, the pushing mechanism comprising a movable spring portions, a pushing rod portion, compression spring, a stationary iron core, a movable iron core and a return force spring, wherein the return force spring is mounted between the movable iron core and the stationary iron core. In that case, countersinks are required to be provided in the movable iron core and the stationary iron core, and thusly allowing the both ends of the return for spring to be positioned into the countersinks in the movable and stationary iron cores, respectively. Due to such structure, the opposing magnetic pole area between the movable iron core and the stationary iron core will be decreased, and thusly decreasing the driving force and holding three of the iron cores. In order to keep the driving force and holding force of the iron cores, a larger coil is usually required, resulting an increased cost and increased size of the product. The framework portion typically comprises a lead terminal portion and a framework acting as a current carrying housing. The lead terminal portion is formed by a lead terminal and a stationary contact, and the lead terminal and the stationary contact are fixed with each other by welding. The lead terminal portion is mounted on the framework, the movable spring portion of the pushing, mechanism is accommodated within the framework, and the movable contact of the movable spring portion and the stationary contact of the lead terminal portion are located in matching position. In order to extinguish the arc, a permanent magnet is usually provided all around the framework. The arc is extinguished by means of the permanent magnet. Using the permanent magnet will cause the cost to be increased. Certainly, there is also a solution without any permanent magnets, in which solution the arc is extinguished by increasing the contact gap. In such solution, the contact gap has to be very large, which will lead to the disadvantages that the size of the product is increased and the acting time of the product is lengthened. In addition, welding the lead terminal and the stationary contact may also lead to the disadvantages of high cost and low efficiency.

SUMMARY

A purpose of the present invention is to overcome the defects in the prior art, and to provide a framework of a relay which can achieve a better arc extinguishing without the disadvantages of increased product cost, enlarged product size and elongated product acting time. Also, the framework has the properties of low cost, high efficiency, universality and flexibility.

A purpose of an aspect of the present invention is to solve the technical problems in the art that the plastic framework is damaged by the arc.

A purpose of an aspect of the present invention is to solve the technical problems in the art that the full ceramic framework of the relay has a high cost.

To solve the technical problems, in a technical solution of the present invention there is provided a framework of a relay, is cavity portion is thrilled inside the framework and a window is formed on the periphery of the framework, the window communicates the outside of the framework and the cavity portion; at least one set of contacts that are contactable correspondingly with each other arc accommodated inside the cavity portion; an arc gap is formed between the contacts that are contactable with each other, the window is aligned with the arc gap from outside.

In another implement there is provided a relay, comprising a lead terminal portion, a movable spring portion, an magnetic circuit portion, a pushing mechanism and a framework portion as above-mentioned, wherein the magnetic portion is connected to a side of the framework portion, the magnetic portion brings the movable contacts on the movable spring portion to act through the pushing mechanism.

As known from the above description to the present invention, the invention has the following advantages compared with the prior art:

The main body of the framework is formed as a hollow injection molding framework and has a plurality of windows aligning to the arc gaps from outside, and thusly the material may be saved and cost may be reduces with ensured structure strength. The windows may be used far mounting functional components such as a magnetic steel, an and resistance pieces and an arc attracting and extinguishing pieces. The framework is suitable to be applicable to relays and breakers having more functions and requirements, so as to improve a scope of application of products to a great extent and facilitate reduction of molds and other manufacturing costs.

DETAILED DESCRIPTION

Features and advantages of the present invention will be apparent from the examplary embodiments in the following description. It is appreciated that the present invention may have various modifications from different embodiments without departing the scope of the present invention, and that the description and drawings therein are intended to be explanatory, rather than limiting the present invention.

The orientation terms like up, down, top and bottom referred in the present invention are merely used for explain the relative positions of the components, rather than defining the specific mounting orientations of the components of the present invention.

Figure 1:
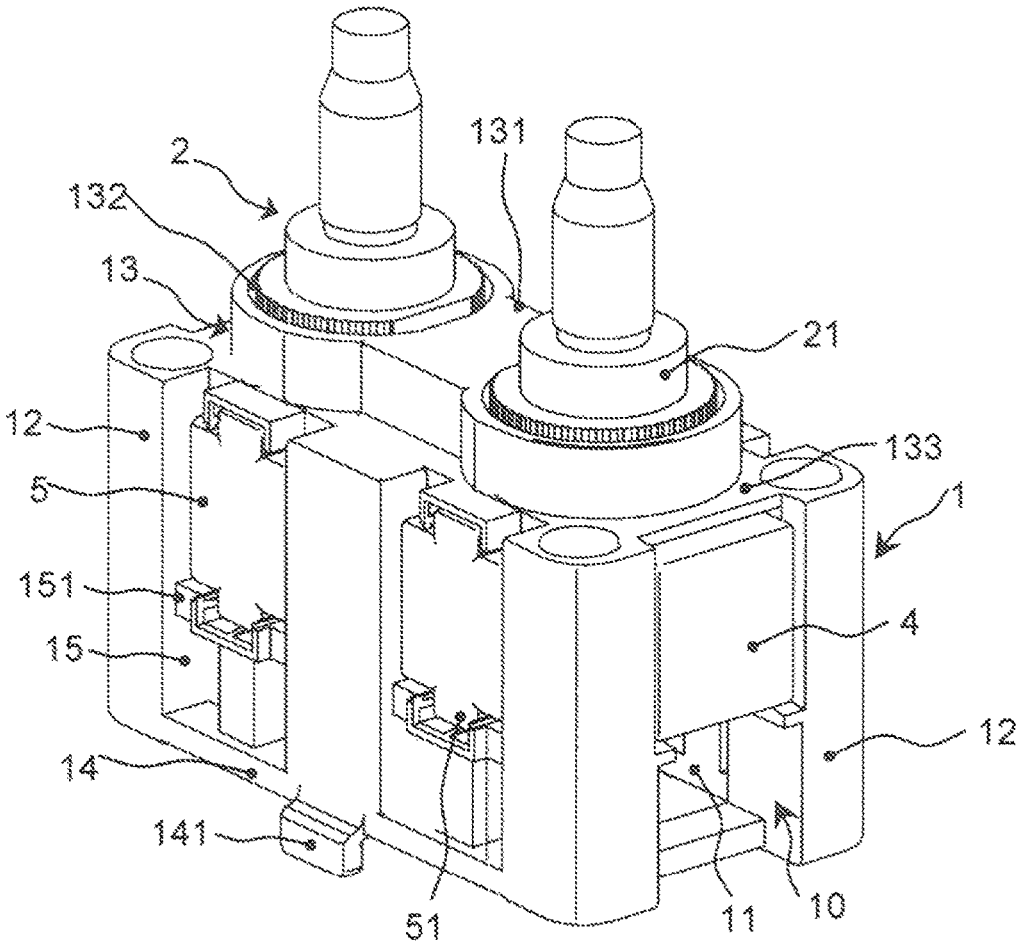
FIG. 1 is a structural schematic view of a relay framework of a first embodiment of the present invention.
Figure 2:
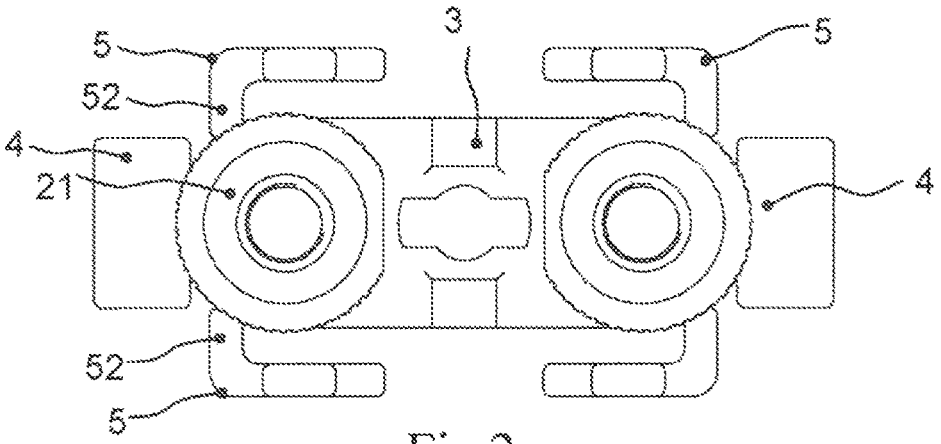
FIG. 2 is a schematic to view showing the acting principle of the relay framework of the first embodiment of the present invention.
Figure 3:
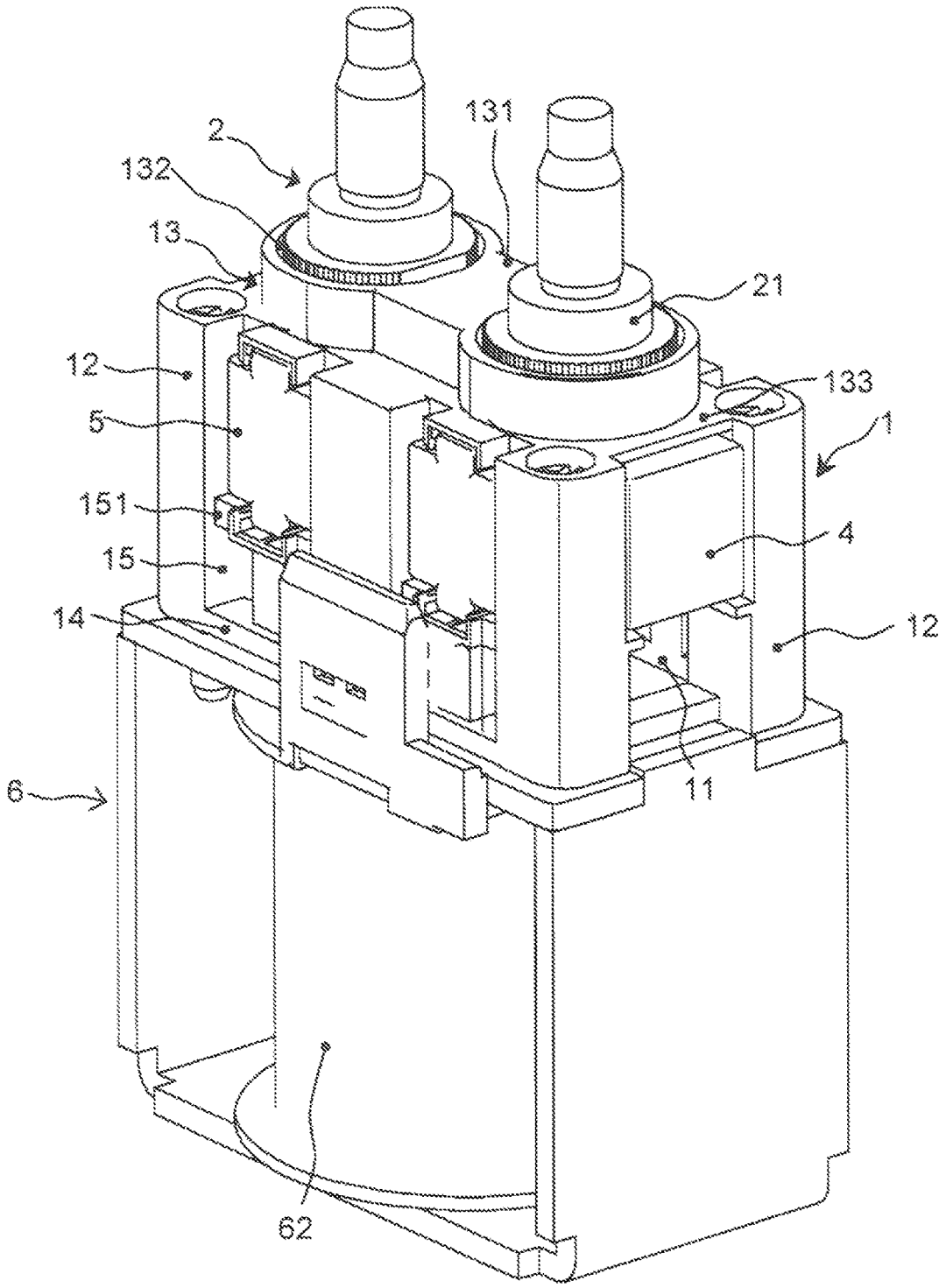
FIG. 3 a structural schematic view of a relay of the first embodiment of the present invention.

As show in FIGS. 1-3, a first embodiment of the present invention provides a framework of a relay, comprising a lead terminal portion 2, a framework main body 1, at least one magnetic steel 4 and at least one are resistance piece 5. A hollow portion 10 is formed inside the framework main body 1, the hollow portion 10 comprising a cavity portion 11 therein and one or more window 15 on its periphery. The windows 15 communicate the outside of the framework main body 1 and the cavity portion 11. The cavity portion 11 accommodates the movable spring portion of the pushing mechanism of the relay. The lead terminal portion 2 comprises a lead terminal 21 and a stationary contact 22. The stationary contact 22 is fixedly connected to the bottom of the lead terminal 21. The contacting surfaces of the stationary contact 22 face the cavity portion 11.

Figure 4:
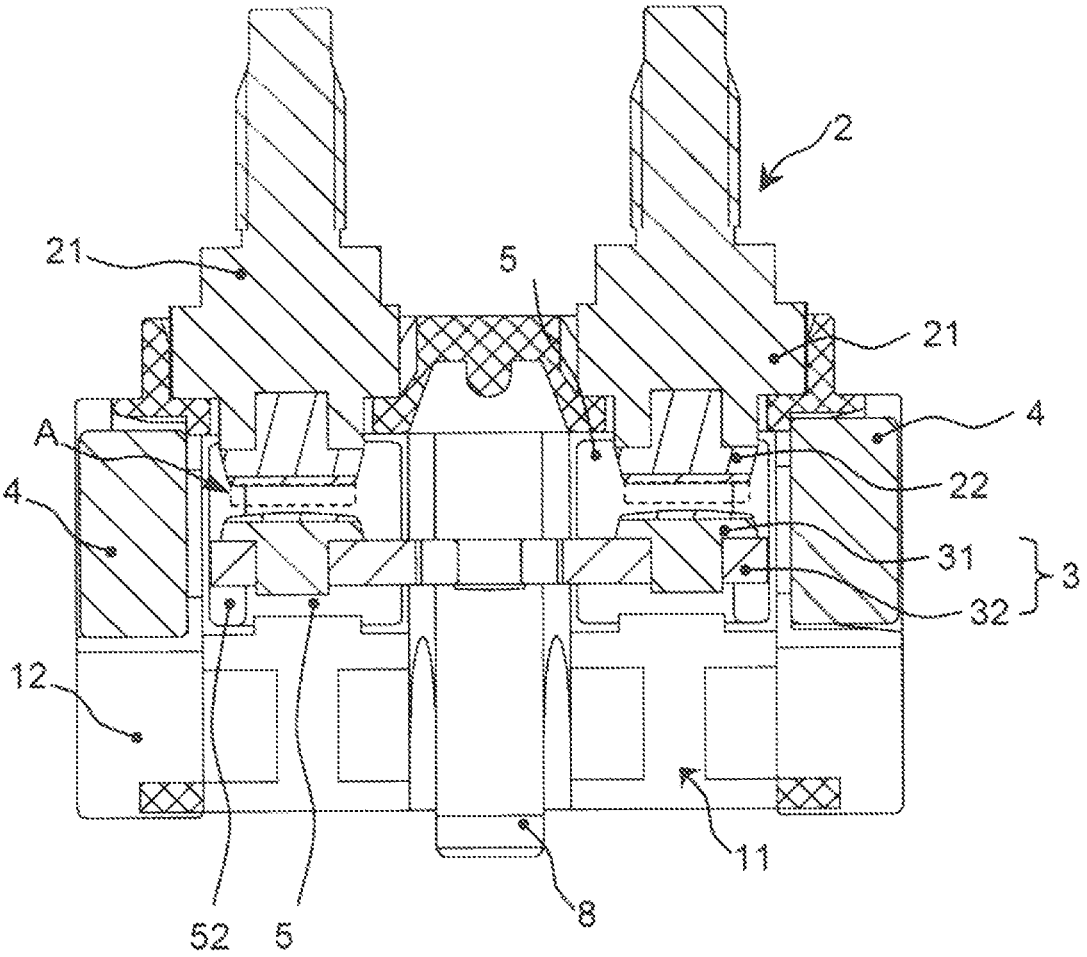
FIG. 4 is a structural cross-section schematic view of relay framework of a first embodiment of the present invention.

The stationary contacts 22 on the bottom of the lead terminal portion 2 correspond to and match with the movable contacts 31 of the movable spring portion 3 respectively (see FIG. 4). The stationary contacts 22 may correspond to and contact with the movable contacts 31, and an arc gap A is formed therebetween. Each of the windows 15 may be aligned with the arc gap A from outside (see FIG. 4). As described here, the corresponding and contacting contacts may be a set of electric contacts that can contact with each other, and also, may be two or more sets, each set of the contacts comprises as movable contact 31 and a stationary contact 22. The gaps for are burning between the contacts are arc gaps A which may be smaller than the maximum gap between the contacts.

The magnetic steel 4 may be mounted to the window 15 of the framework main body 1. The magnetic steel 4 is located on the periphery of the cavity portion 11. The magnetic steel 4 may perform arc blowing to the are created when breaking contact in the arc gap A inside the cavity portion 11. The arc resistance piece 5 is mounted to the window 15 of the framework main body 1, and is located on the are blowing direction of the magnetic steel 4. In the case that the contacts are multiple sets, the form of the corresponding framework main body is not limited to the shape as shown in the figures, and the arc resistance piece 5 and magnetic steels 4 may be increased correspondingly in sets. The expression that the resistance are piece 5 is located "on the arc blowing direction of the magnetic steel 4" means, under the magnetic field of the magnetic steel 4, the are at the arc gap A is blown towards the periphery direction, and the arc resistance piece 5 can block the arc blown by the magnetic steel 4 so as to extinguish the arc and lower the temperature. In a better method, for easier mounting, a ceramic piece 5 may be also arranged symmetrically with its center aligned with that of the arc gap A.

When the relay is applied for a relatively higher load, it the arc strike on the plastic around the contacts, the plastic may be carbonized and the insulation property may be decreased sharply. In order to avoid this, in an embodiment of the present invention, an arc resistance piece 5 that can resistant high temperature, such as a ceramic piece, is mounted symmetrically close to the arc gap A. The arc resistance material has the effect of cooling the arc, improves the reliability and electric life of the product, has a cost lower than that of a framework entirely made of ceramic material, and may make the structure of the framework more concise. Here, the magnetic steel 4 is the arc blowing device, and certainly, an electromagnetism arc blowing device or other arc blowing devices may be used.

In particular, the first embodiment is shown in FIG. 1. The framework main body 1 has a general hollow cuboid shape. The framework main body 1 is made of plastic and comprises a plurality of posts 12, an upper mounting portion 13 and a lower connection portion 14. Each of the posts 12 arc arranged separately OP the periphery of the hollow portion 11, the windows 15 of opening type is formed between the adjacent posts 12. The upper mounting portion 13 is connected to each of the posts 12 on the upper portion. A connection plate 133 as a main body of the upper mounting portion 13 has a fixing portion 131 protruding from the top portion thereof. The fixing portion 131 has rounded shapes on its both ends, and two positioning holes 132 having a distance therebetween are formed on the fixing portion 131, the positioning holes 132 are stepped holes such that the lead terminal portion 2 of the relay can be fixed. The lower connection portion 14 is connected to each of the posts 12 on the lower portion. In the present embodiment, the lower connection portion 14 is an elongated plate piece connected between the posts 12, and is provided with a snapping portion 141 so as to be fixedly connected to a magnetic circuit system 6. Certainly, a screwing portion or a riveting portion can be used to achieve the above connection.

The framework main body 1 is a hollow framework and has a plurality of windows 15 being aligned to the are gaps from outside, which allows saving materials and lowering costs with ensured structure strength.

Here, as shown in FIG. 2, the contactable contacts are two separated groups, corresponding to two separated arc gaps A. The contacts consist of movable contacts 31 located correspondingly inside the cavity portion 11 and stationary contacts 22 fixed to the upper portion inside the framework main body 1. The movable contacts 31 may be driven by a pushing mechanism so as to contact/break from the stationary contacts 22.

In the first embodiment as shown in FIGS. 1, 2 and 4, the positions of the windows are aligned with the arc gaps A from outside. Two magnetic steels 4 are mounted respectively on the windows 15 on the extension line extending from a connecting line between the two arc gaps A. Here, the referred "connecting line between the two arc gaps A" may be a connecting line between the center points. The magnetic steels 4 may be embedded into the framework main body without any additional fixing components and any mounting space for the fixing components, so as to decrease the outline size of the product. And the magnetic steels may be very close to the contacts, which will be advantageous to increase the magnetic field density passing through the contacts so as to improve the arc blowing capacity. Two pairs of arc resistance pieces 5 are mounted to the two windows 15 outside the are gaps, respectively. The connecting line between the centers of two corresponding resistant arc pieces 5 is perpendicular to the connecting line between the two arc gaps A.

Figure 6:
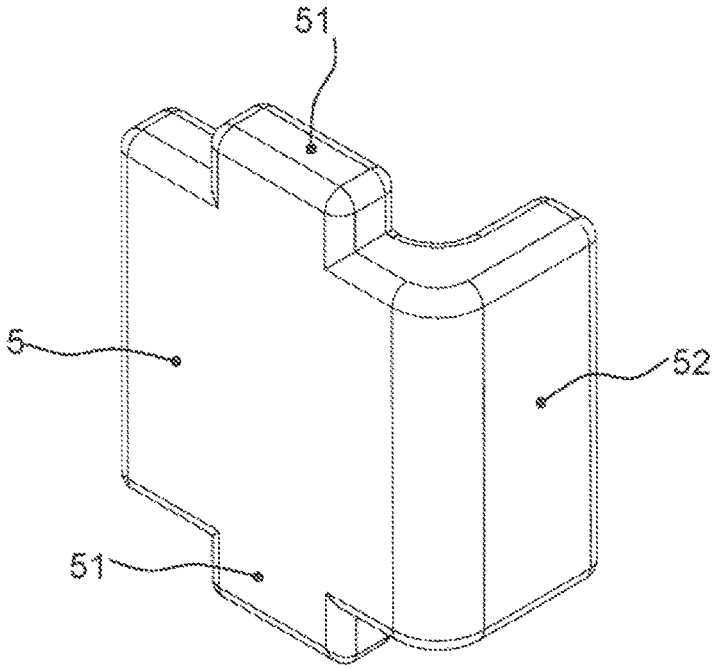
FIG. 6 a structural schematic view of an are resistance piece of the first embodiment of the present invention.
Figure 7:
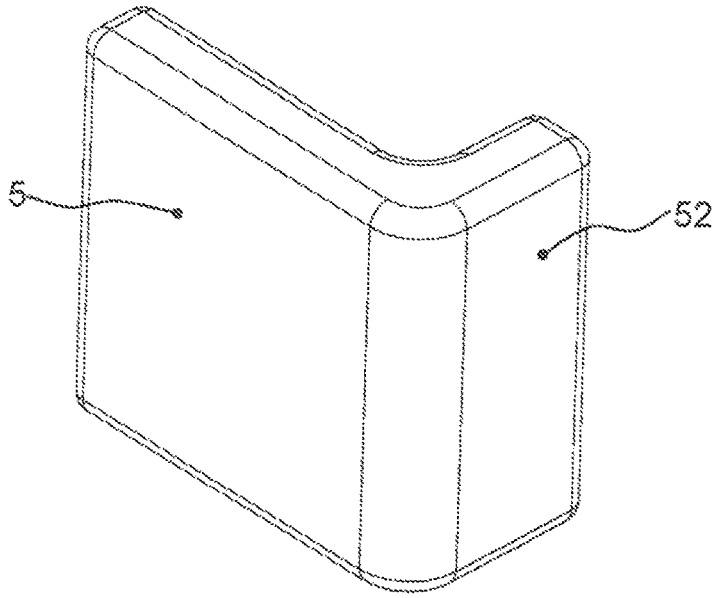
FIG. 7 is a structural schematic view of another embodiment of an arc resistance piece of the present invention.

The high temperature resistance material of the are resistance pieces 5 may be PET/GF antiflaming arc resistance composite materials, composite polytef arc resistance material; heat and arc resistance organosilicon plastic or ceramic pieces. In the materials as above, the ceramic pieces has low cost and stable properties, and the are resistance pieces 5 in an embodiment of the present invention are thusly made of ceramic material. As shown in FIGS. 6 and 7, at lease one edge of the arc resistance piece 5 extends along an edge of the corresponding window 15 to form an inside extension portion 52. The arc resistance piece 5 forms a L-shaped right angled shape. Since the arc has a cylindrical shape in operation and will moves along a parabola to a side under the magnetic blowing of the magnetic steel 4, the right angled ceramic piece may increase the protection range. As shown in FIG. 7, the top surface, bottom surface or two sides of the arc resistance piece 5 may partially protrude outside to form a protruding block 51 or a recess block.

Limit ribs 151 may be formed at the position on the windows 15 where the arc resistance pieces 5 are mounted. Both ends of the limit ribs 151 are connected to the posts 12 on both sides. The shape of the limit ribs 151 fit the shape of the arc resistance piece 5. As shown in FIGS. 1-3, middle portion of the limit rib 151 has a U-shaped recess, and the limit rib 151 has a snapping strip on a surface contacting with the edge of the arc resistance piece 5 inside the recess. The snapping strip has a slope tightly snapping the edge of the arc resistance piece 5 from outside to inside. A clamping portion is formed accordingly on the mounting positions of each of the windows 15. The arc resistance piece 5 is mounted to the framework main body 1 by snapping or embedding. At the same time, a housing of the product presses against the arc resistance piece 5 from outside, so as to position the are resistance piece 5 from six directions.

The arc resistance piece 5 may be fixed by, besides the above-mentioned manner, integrally injected together with the framework main boy, or snapped into the framework main body by an up-down slot, and so on.

Figure 8:
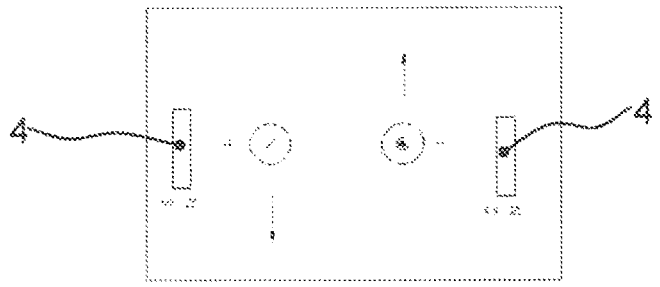
FIG. 8 is a schematic view showing the acting principle of arc blowing of the first embodiment of the present invention.

With reference to the schematic diagram of FIG. 8, two magnetic steels 4 are mounted on the extension line extending outside from the connecting line between the two arc gaps. There is no requirement for the magnetic poles of the two magnetic steels, but preferably, the opposite surfaces of the two magnetic steels have reversed magnetic poles. The direction of the magnetic lines is perpendicular to that of the arc created by the contacts. In this way, when an arc is created between the contacts, the two magnetic steels 4 can blow the arc to both sides. Even if the current in the two contacts change their direction, the arc will still be blown to a side, and even if the magnetic poles of the two magnetic steels 4 arc wrongly mounted, the arc will still be blown to a side, and thusly the safety of the product will be still ensured. In the present embodiment, the framework is provided with magnetic steels symmetrically on both sides. In this way, when an arc is created between the contacts, the two magnetic steels will blow the arc form two side directions. Even if the current in the two contacts change their direction, the magnetic blowing direction will still be directed to a side, And even if the magnetic poles of the two magnetic steels are mounted improperly, the magnetic blowing direction is still directed to a side, and the safety of the product is still ensured.

Figure 9:
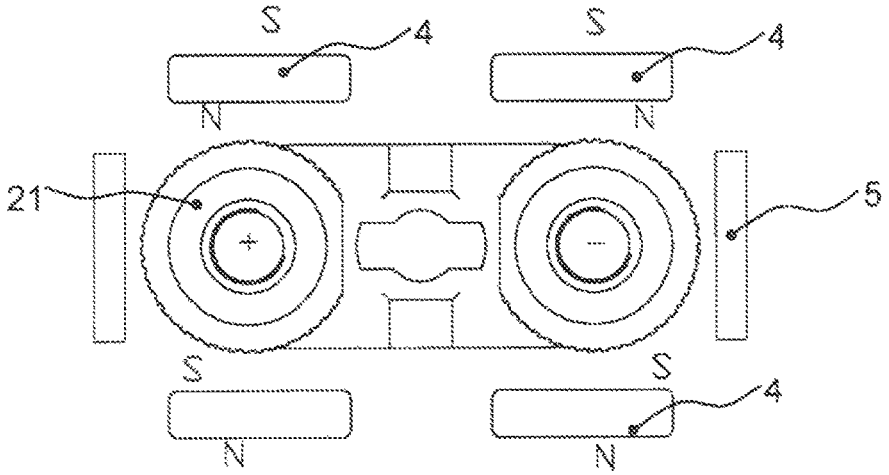
FIG. 9 is a schematic to view showing the acting principle of the relay framework of a second embodiment of the present invention.
Figure 10:
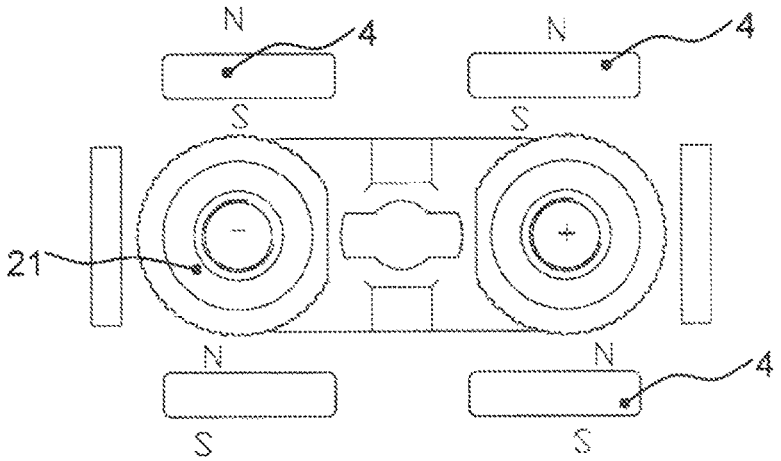
FIG. 10 is a schematic top view showing the acting principle of the relay framework of a second embodiment of the present invention.
Figure 11:
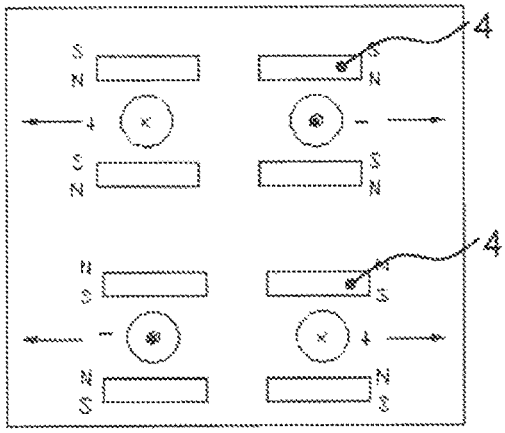
FIG. 11 is a schematic view showing the acting principle of arc blowing of the second embodiment of the present invention.
Figure 12:
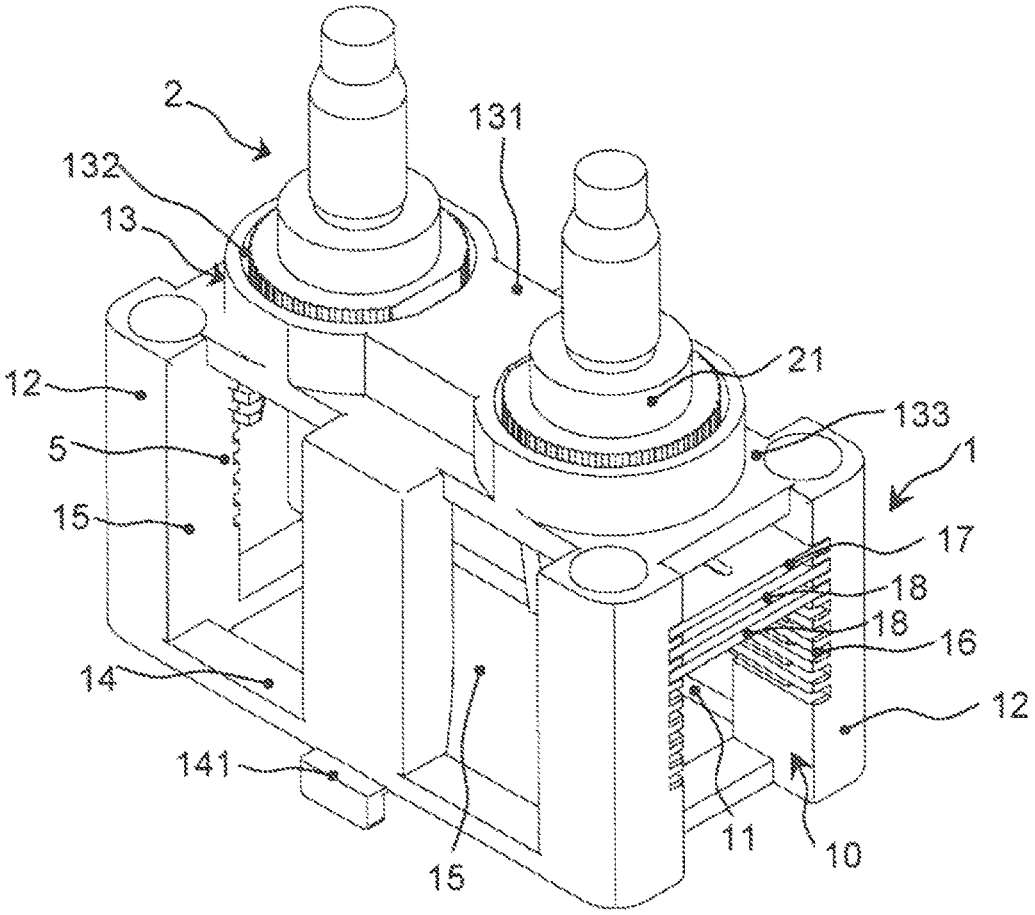
FIG. 12 is a schematic perspective view showing the structure of a third embodiment of the present invention.
Figure 13:
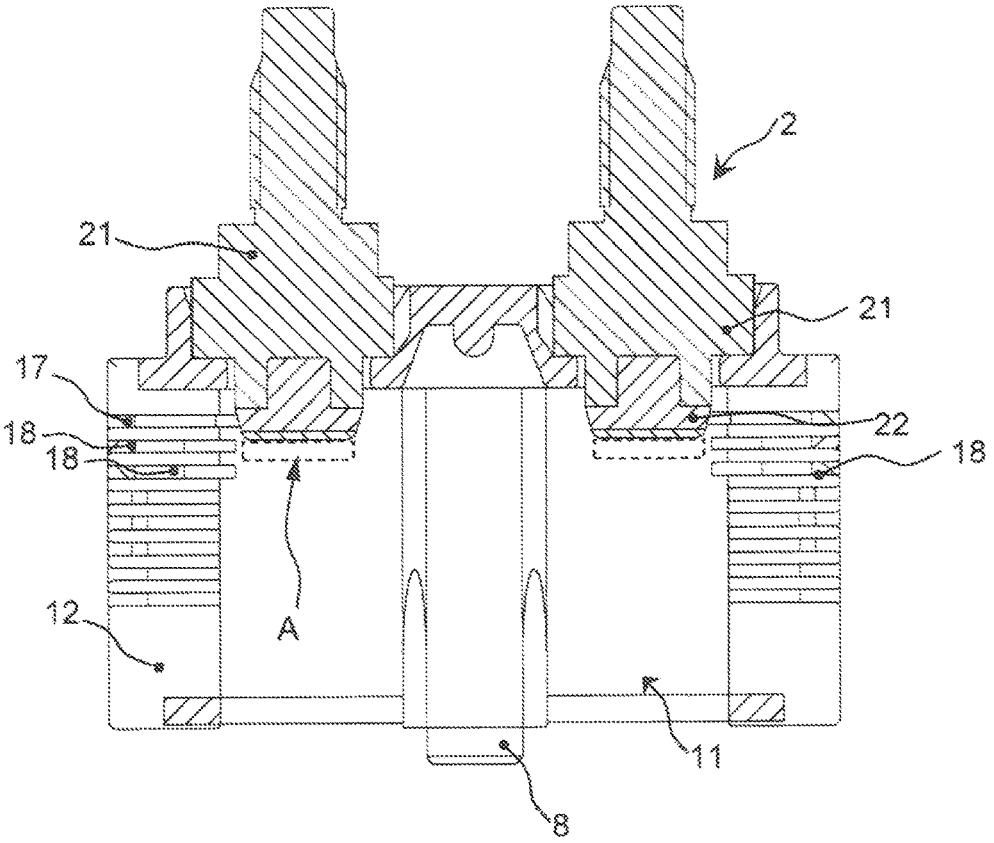
FIG. 13 is a structural cross-section view of the third embodiment of the present invention.
Figure 14:
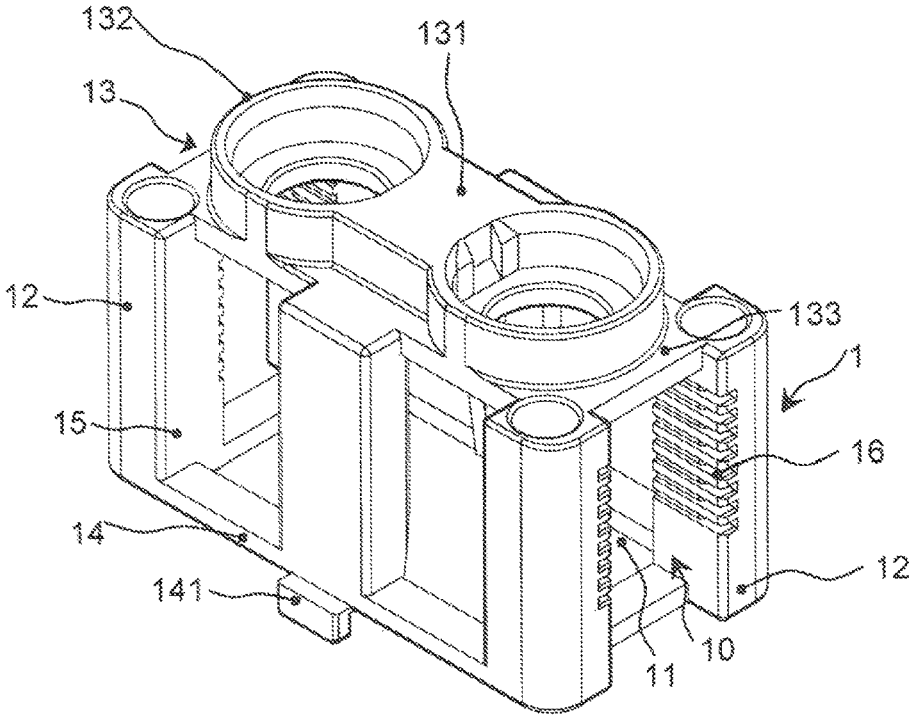
FIG. 14 is a schematic perspective view slowing the structure of the framework of the third embodiment of the present invention.
Figure 15:
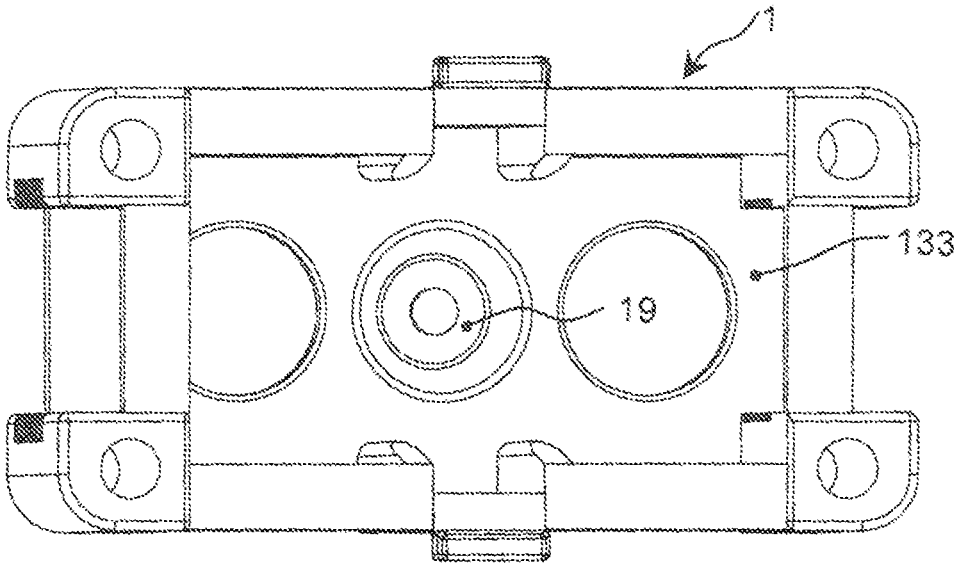
FIG. 15 is a structural schematic view showing the framework (the bottom surface is turned to the front) of the third embodiment of the present invention.
Figure 16:
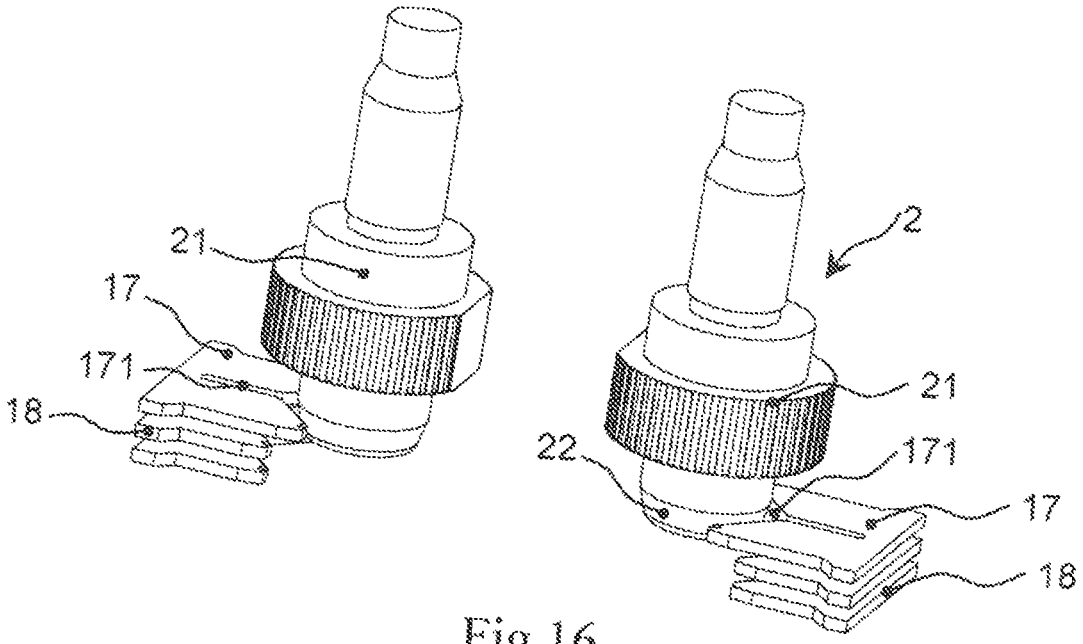
FIG. 16 is a schematic view showing the lead terminal portion matched with a first and a second arc extinguishing piece.

Certainly, in a second embodiment as shown in FIGS. 9-11, a pair of arc resistant pieces 5 may be mounted to the windows 15 on the extension line extending outwardly from the connecting line between the two arc gaps A, and the magnetic steel 4 may be mounted on the two windows 15 outside the are gaps A, the connecting line between the centers of the two corresponding magnetic steels is perpendicular to the connecting line between the two arc gaps A. Similarly, the arc resistance piece 5 is positioned on the blowing direction of the magnetic steel 4. In this case, according to the flow direction of the current, the poles of the four magnetic steels should be arranged in two manners as shown in FIG. 11, the opposing surfaces of opposing magnetic steels should have reversed polarity. According to the left-hand rule in electromagnetism, one flatten his hand and let the magnetic lines to pass through his palm, his thumb being perpendicular to the other four fingers and in the same plane with the palm. When the left hand is put into the magnetic field, with the magnetic lines passing through the palm perpendicularly, the palm facing the N pole, and the four fingers being oriented in the direction of the current, the direction of the thumb will be the direction of force. When an arc is created in the magnetic field, the force acting thereon will follow the left-hand rule, and the force on the arc acted by the magnetic steel will be directed outwards.

Figure 5:
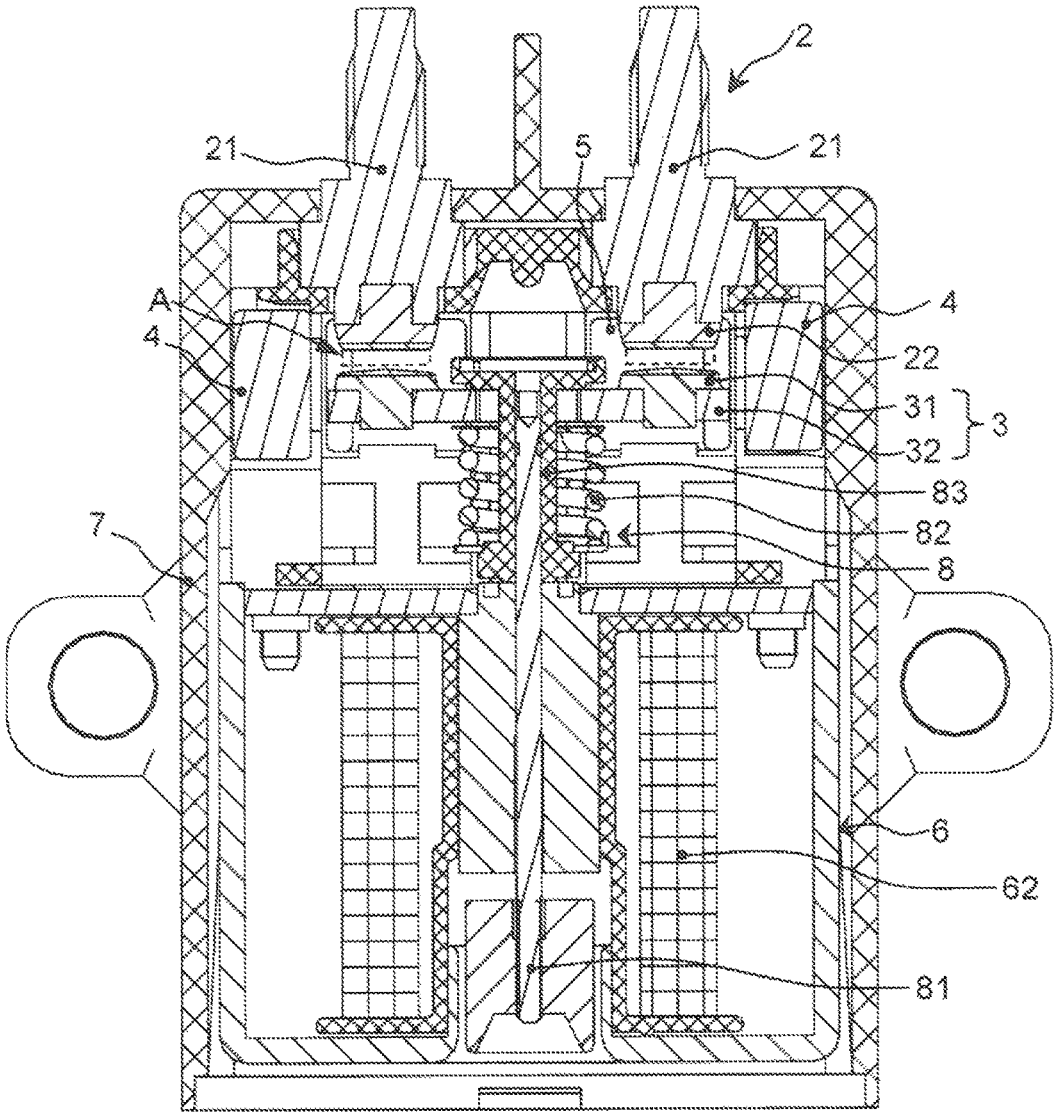
FIG. 5 is a structural schematic cross-section view of the relay of the first embodiment of the present invention.

An embodiment shown in FIGS. 3-5 is the above-mentioned embodiment applied on a relay. Generally, the relay further comprises a lead terminal portion 2, a movable spring portion 3, a magnetic circuit system 6, a housing 7 and a pushing mechanism 8. The lead terminal portion 2 comprises a lead terminal 21 and a stationary contact 22. The stationary contact 2.2 is fixedly connected to the bottom of the lead terminal 21, for example, by riveting manner. The contacting surface of the stationary contact 22 faces a cavity portion 11. A movable contact 31 is fixedly mounted to a movable spring 32 of the movable spring portion 3, and located correspondingly into the cavity portion 11. The pushing mechanism 8 is driven by the magnetic circuit system 6 and drives the movable spring portion 3 to move. The pushing mechanism 8 comprises a pushing rod 81, a limit elastomer 82, an isolation sheath 83, and so on. The main body of the pushing rod 81 is mounted in a coil 62 of the magnetic circuit system 6 with its one end extending outwards to be fixed to the isolation sheath 83. The limit elastomer 82 is a spring. An upper end surface of the movable spring portion 3 abuts the isolation sheath 83, and a lower end surface of the movable spring portion 3 is fixed by the fitting of the isolation sheath 83 and the positioning spring 82. The magnetic circuit system 6 is moved by the pushing mechanism 8 driving the movable spring portion 3. The closing or breaking of the relay is achieved b the corresponding fittings of the stationary contacts 22 of the two lead terminal portion 2 with the movable contacts 31 of the movable spring portion 3, respectively.

The arc resistance material in the above-mentioned embodiment of the present invention has the effect of cooling the arc, improves the reliability and electric life of the product, has a cost lower than that of a framework entirely made of ceramic material, and may make the structure of the framework more concise.

As shown in FIGS. 12-19, likewise, a framework portion of a relay of a third embodiment of the present invention comprises a lead terminal portion 2 and a framework main body 1. The lead terminal portion 2 comprises a lead terminal 21 and a stationary contact 22. The stationary contact 22 is fixedly connected to the bottom of the lead terminal 21. The framework main body 1 is provided with a hollow portion 10 for accommodating a movable spring 3 of a pushing mechanism of the relay. The two lead terminal portions 2 are mounted respectively to the top of the hollow portion 10 of the framework, allowing the stationary contacts 22 of the two lead terminal portions to correspondingly fit the movable contacts 31 of the movable spring portion 3. The differences between the first and second embodiments be in that the windows 15 on both sides of the hollow portion 10 of the framework main body 1 are provided symmetrically with a plurality of slots 16. Said slots 16 are arranged from up to down, and both ends of the plurality of slots 16 communicate with the outside of the framework main body 1 and the hollow portion 10 of the framework, respectively.

Said plurality of slots 16 are arranged with distances in a direction from up to down.

The framework further comprises two first arc extinguishing pieces 17 and at least two second are extinguishing pieces 18. Said two first arc extinguishing pieces 17 are symmetrically mounted into the slots 16 in the uppermost layer on both sides of the framework, respectively, and the two first arc extinguishing pieces 17 are close to or abut against the corresponding lead terminal portions 2, respectively. Said at least two second arc extinguishing pieces 18 are symmetrically mounted into the corresponding slots 16 on both sides of the framework, respectively, and located below and adjacent to the first arc distinguishing pieces 17. The second arc extinguishing pieces 18 have a length smaller than that of the first arc extinguishing pieces 17, such that there are distances between the second are extinguishing pieces 18 and the lead terminal portions in the projection plane. In this embodiment, there are four second arc extinguishing pieces 18. Each sides of the framework main body 1 is mounted with two second arc extinguishing pieces 18.

Said first arc distinguishing pieces 17 and second arc extinguishing pieces 18 are each provided with an opening facing the inside of the framework. That is, the first arc distinguishing pieces 17 are provided with openings 171 facing the inside of the framework, and likewise, the second arc distinguishing pieces 18 are provided with openings (not shown in the figures) facing the inside of the framework.

Said openings 171 of the first are distinguishing pieces 17 is close to or abut against the corresponding lead terminal portion 2.

Said openings 171 of the first arc distinguishing pieces 17 may have a Y-shape, and certainly may have a V-shape. Likewise, the openings of the second arc distinguishing pieces 18 have a Y-shape.

Said openings 171 of the first are distinguishing pieces 17 is close to or abut against the stationary contacts 22 of the corresponding lead terminal portions.

A recess for placing a return force spring of the pushing mechanism is also provided on the top of the hollow portion of said framework, so as to provide a return force for the pushing mechanism.

The bottom of the lead terminals and said stationary contacts are fixed with each other by riveting.

A recess 19 for placing a return Mice spring of the pushing mechanism is also provided on the top of the hollow portion of said framework main body 1, so as to provide a backward force for the pushing mechanism.

The bottom of the lead terminals 21 and said stationary contacts 22 are fixed with each other by riveting.

Figure 17:
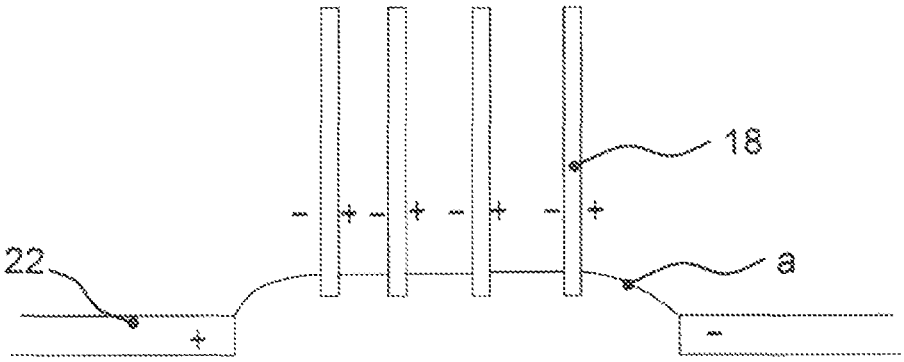
FIG. 17 is a schematic view showing the arc extinguishing principle of the third embodiment of the present invention.
Figure 18:
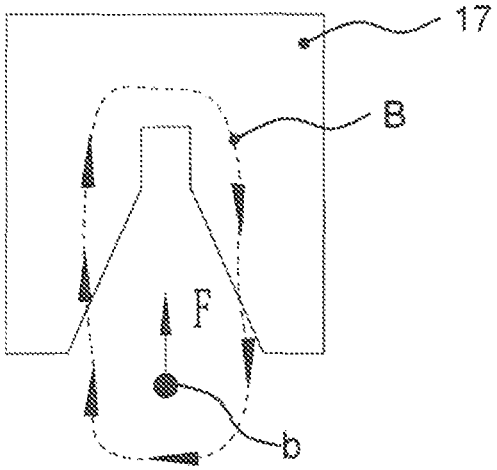
FIG. 18 is a schematic view showing the acting of the arc extinguishing piece of the third embodiment of the present invention.
Figure 19:
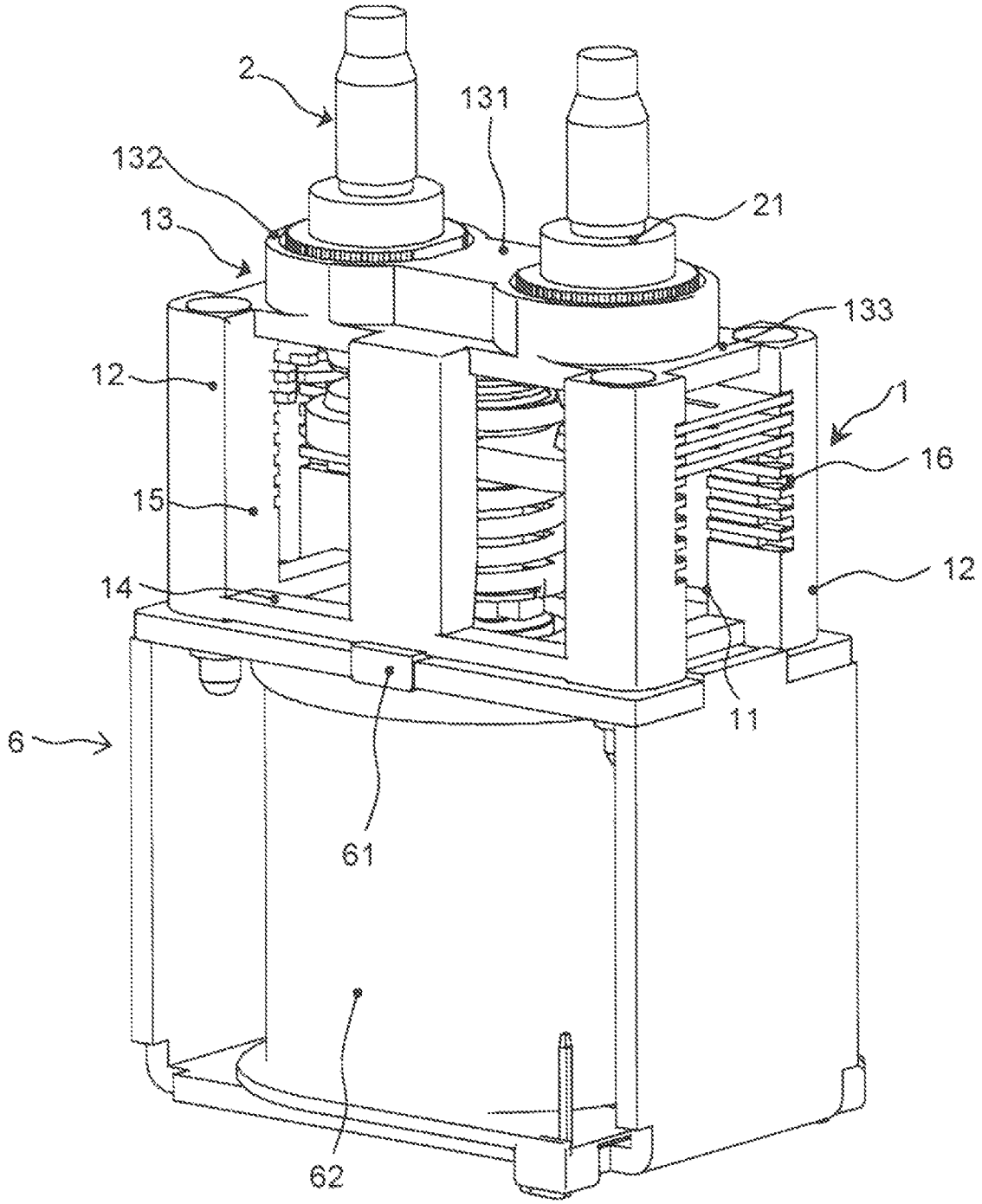
FIG. 19 is a schematic view showing the present invention mounted on a relay.

The third embodiment of the present invention provides a framework portion of a relay, wherein a plurality of slots 16 are provided symmetrically on both sides of the framework. The plurality of slots are arranged from up to down, and both ends of the plurality of slots 10 communicate with the outside of the framework main body 1 and the hollow portion 10 of the framework, respectively. In this way, an are extinguishing pieces may be selected to be used or not used according to different loads. In the case of a small load, the arc extinguishing piece may be not used, and the arc is extinguished by a contact gap; in the case that the arc extinguishing pieces is needed, besides using a first are extinguishing piece 17, different numbers of second arc extinguishing pieces may be selected and used according to different load, so as to achieve a best arc extinguishing effect, and has universality and flexibility. In this embodiment, first arc extinguishing pieces 17 are inserted into the slots 16 in an uppermost layer on both sides of the framework, and two first arc extinguishing pieces 17 are close to or abut against the contacts 12 of the corresponding lead terminal portions, respectively, forming unipotential positions with the contacts 12, so as to perform arc extinguishing, and avoid the disadvantage caused by arc extinguishing with permanent magnetic or enlarged contact gap as done in the prior art. A better arc extinguishing effect may be achieved without the disadvantages of increased cost, enlarged product size and prolonged product acting time. In this embodiment, the arc extinguishing is also achieved by inserting one or more second arc extinguishing pieces 18 under the first arc extinguishing pieces 17 on both sides of the framework, the second arc extinguishing pieces 18 are cooperated with the first arc extinguishing pieces. The one or more second arc extinguishing pieces 18 are arranged with distances therebetween under the first arc extinguishing pieces 17, so as to divide the are into a lot of short arcs a (as shown in FIG. 17) to extinguish the arc. In this embodiment, each of the first arc extinguishing pieces 17 and second arc extinguishing pieces 18 is provided with an opening facing the inside of the framework, and each of the openings of the first arc extinguishing pieces and second arc extinguishing pieces has a Y shape (may be a V shape instead). Due to this structure, the magnetic circuit path created by the are current in surrounding spaces is deformed, thereby an attraction force F (as shown in FIG. 18, the letter B in FIG. 18 indicating the magnetic path) is created to bring the arc b to the arc extinguishing pieces, so as to achieve better arc attraction and extinguishing fleets. In this embodiment, a recess 19 for placing the return force spring is provided on a top of a hollow portion of the framework for providing a return force for the pushing mechanism, which eliminate the disadvantage in the prior art caused by the return force spring placed between the movable iron core and the stationary iron core. In this embodiment, the stationary contacts 22 and lead terminals 21 are fixed by riveting, which may red ace cost and improve efficiency.

Although the present invention has been described with respective to several exemplary embodiments, it should be appreciated that the terms used are intend to illustrative and exemplary, rather than limiting terms. Since the present invention can be specifically implemented in various manners without departing the spirit or substance thereof, it should be appreciated that the abovementioned embodiments are not limited to any aforementioned details, and should be explained broadly within the spirit and scope defined by the appending claims. Therefore, all the variations and modifications in the scope of the claims and its equivalents should be covered by the claims.

What is claimed is:

1. A framework portion of a relay, wherein:

a hollow portion is formed inside the framework and a window is formed on the periphery of the framework, the window communicates the outside of the framework and the hollow portion; two sets of contacts that are contactable correspondingly with each other are accommodated inside the hollow portion; an arc gap is formed between the contacts that are contactable with each other, the window is aligned with the arc gap from outside, wherein the framework is formed integrally, and is made of plastic materials, the two sets of contacts include the movable contacts and stationary contacts, respectively, a main body of the framework comprises a plurality of posts, an upper mounting portion and a lower connection portion, each of the posts is arranged with distances on a periphery of the hollow portion, the windows are formed between adjacent posts; the upper mounting portion is connected with each of the posts at an upper portion; the lower connection portion is connected with each of the posts at a lower portion; and the lower connection portion is fixedly connected with a magnetic circuit system, wherein the framework portion further comprises at least one magnetic steel and at least one arc resistance piece; the magnetic steel is mounted to the windows, the magnetic steel is located on the periphery of the arc gaps, and the magnetic steel blow an arc created at the arc gaps; the arc resistance piece is mounted to the windows, and the arc resistance piece is located in the direction of the arc blowing direction of the magnetic steel.

2. The framework portion of the relay according to claim 1, wherein a plurality of slots are provided symmetrically in a transverse direction on the windows symmetrically located on both sides of the framework, respectively, the plurality of slots are arranged from up to down, and the both ends of the slots communicates outside of the framework and the hollow portion.

3. The framework portion of the relay according to claim 2, wherein the plurality of slots are arranged from up to down with distances therebetween.

4. The framework portion of the relay according to claim 3, wherein the framework portion further comprises two first arc extinguishing pieces and at least two second arc extinguishing pieces; the two first arc extinguishing pieces are mounted symmetrically in the slots on a uppermost layer of both sides of the framework;

and the two first arc extinguishing pieces are close to or abut against the corresponding contacts that are contactable correspondingly, the at least two second arc extinguishing pieces are mounted symmetrically in the corresponding slots on both sides of the framework, abut under the first arc extinguishing pieces; and the second arc extinguishing pieces have a length smaller than that of the first arc extinguishing pieces, such that the second arc extinguishing pieces are spaced from the corresponding contacts with a certain distance in a projection plane.

5. The framework portion of the relay according to claim 4, wherein each of the first arc extinguishing pieces and second arc extinguishing pieces is provided with an opening facing inwards the framework, the openings of the first arc extinguishing pieces are close to or abut against the corresponding arc gaps.

6. The framework portion of the relay according to claim 5, wherein each of the openings of the first arc extinguishing pieces and second arc extinguishing pieces has a Y-shape.

7. The framework portion of the relay according to claim 1, wherein the magnetic steel blow the arc towards the outside of the reply or the outside of the contactor framework with the function of the magnetic field of the magnetic steel.

8. The framework portion of the relay according to claim 7, wherein the arc resistance piece is made of a ceramic piece.

9. The framework portion of the relay according to claim 8, wherein the magnetic steels are provided in pairs, and opposing surfaces of opposing magnetic steels have reversed magnetic poles.

10. The framework portion of the relay according to claim 9, wherein the framework portion comprise two sets of parallel contacts, and the arc gaps having two spaces; the magnetic steels is located respectively along an extension line extending outwards from a connecting line between the two arc gaps; at least two pairs of the arc resistance pieces are mounted on an outside of the arc gaps, a connecting line between centers of corresponding arc resistance pieces is perpendicular to that between the two arc gaps.

11. The framework portion of the relay according to claim 10, wherein the arc resistance piece is mounted to the main body of the framework by means of snapping or embedded pieces.

12. The framework portion of the relay according to claim 10, wherein a limit rib is formed on the mounting position of the main body of the framework, the limit rib has a shape matching with a shape of the arc resistance piece, and the limit rib has a snapping strip on its surface contacting with an edge of the arc resistance piece, the snapping strip has a slope snapping the edge of the arc resistance piece from outside to inside.

13. The framework portion of the relay according to claim 9, wherein the framework comprises two sets of parallel contacts, and the arc gaps having two spaces; the arc resistance pieces is mounted to the windows in an extension line extending outwards from a connecting line between the two arc gaps; the magnetic steel is mounted to the windows outside the arc gaps, a connecting line between centers of corresponding magnetic steels is perpendicular to that between the two arc gaps.

14. The framework portion of the relay according to claim 8, wherein the arc resistance pieces are provided in pairs, and the arc resistance pieces are provided symmetrically with respect to a center aligned to a center of the arc gap.

* * * * *